US007195293B2

(12) United States Patent
Ala

(10) Patent No.: US 7,195,293 B2
(45) Date of Patent: Mar. 27, 2007

(54) DEVICE FOR OPENING A DOOR OF AN ELECTRIC HOUSEHOLD APPLIANCE, IN PARTICULAR A REFRIGERATOR OR FREEZER

(75) Inventor: Gian Battista Ala, Volpiano (IT)

(73) Assignee: ITW Industrial Components S.R.L., Milan (IT)

( * ) Notice: Subject to any disclaimer, the term of this patent is extended or adjusted under 35 U.S.C. 154(b) by 68 days.

(21) Appl. No.: 11/190,890

(22) Filed: Jul. 28, 2005

(65) Prior Publication Data

US 2006/0033342 A1 Feb. 16, 2006

(30) Foreign Application Priority Data

Jul. 30, 2004 (IT) ..... TO2004A0539

(51) Int. Cl.
*E05B 17/00* (2006.01)

(52) U.S. Cl. ..... 292/254; 292/DIG. 4; 292/DIG. 72; 292/DIG. 37

(58) Field of Classification Search ..... 292/254, 292/255, DIG. 4, DIG. 72, DIG. 37
See application file for complete search history.

(56) References Cited

U.S. PATENT DOCUMENTS

| | | | | |
|---|---|---|---|---|
| 2,659,115 | A | 11/1953 | Anderson et al. | |
| 2,889,787 | A | 6/1959 | Schell | |
| 4,875,721 | A | 10/1989 | Okamoto et al. | |
| 5,570,915 | A | 11/1996 | Asadurian | |
| 5,988,709 | A | 11/1999 | Lee et al. | |
| 6,328,392 | B1 | 12/2001 | Whitcomb | |
| 6,869,114 | B2 * | 3/2005 | Ueki | 292/341.17 |

FOREIGN PATENT DOCUMENTS

| | | | |
|---|---|---|---|
| CH | 379956 | A | 7/1964 |
| EP | 0626494 | A | 11/1994 |
| GB | 840661 | A | 7/1960 |

* cited by examiner

*Primary Examiner*—Gary Estremsky
(74) *Attorney, Agent, or Firm*—Lowe Hauptman & Berner, LLP

(57) ABSTRACT

A device for opening a door of an electric household appliance; the door swinging about an axis of rotation between an open position, into which it is pushed by elastic means, and a closed position, in which it is retained, with the interposition of a peripheral seal, resting against a door stop of a door opening of the appliance, by releasable retaining means; and the device including a supporting member fixable integrally to the door; a button fitted integrally to the supporting member to stay, in use, on the same side of an outer surface of the door, and which is pressure-operated in opposition to first elastic means; a push member fitted to the supporting member to slide, in opposition to second elastic means and along an axis substantially perpendicular to the axis of rotation of the door, between an extracted position extracted from a seat on the supporting member, and a withdrawn position housed inside the seat, which is formed at and substantially flush with the peripheral seal; and bolt means for selectively engaging the push member to lock it in the withdrawn position, and releasing the push member when the button is pressed.

12 Claims, 2 Drawing Sheets

DEVICE FOR OPENING A DOOR OF AN ELECTRIC HOUSEHOLD APPLIANCE, IN PARTICULAR A REFRIGERATOR OR FREEZER

RELATED APPLICATIONS

The present application is based on, and claims priority from, Italian Application Number TO2004A 000539, filed Jul. 30, 2004, the disclosure of which is hereby incorporated by reference herein in its entirety.

The present invention relates to a device for opening a door of an electric household appliance —in particular a refrigerator or a preferably vertical freezer—and which may be used to advantage in any application in which the door is kept closed by retaining means releasable by simply detaching the door from a door stop on the door opening, against which the door normally rests in fluidtight manner in the closed position.

In applications as described above, the door of the appliance is currently opened by the user simply pulling the door manually by means of a handle fitted integrally to the door.

BACKGROUND OF THE INVENTION

Currently used handles, however, are often bulky and unsightly, and to a large extent affect the design of the door.

Moreover, the user must have at least one hand free to grip and pull the handle strongly enough to open the door, e.g. to overcome the resistance of retaining members defined by magnets, which is not always possible, particularly when both hands are required to carry articles to be placed inside the appliance.

In the past, refrigerators have been produced, in which the door is detached, in opposition to the force exerted by the magnets to keep the door shut, by a pedal-operated lever. This solution, however, has since been rejected on the grounds that it failed to replace the handle, involved additional cost, and was aesthetically unsatisfactory and awkward to use.

SUMMARY OF THE INVENTION

It is an object of the present invention to provide a device for opening a door of an electric household appliance—in particular a door kept closed by retaining means releasable by simply detaching the door from a door stop on the door opening—which eliminates the aforementioned drawbacks of known devices, and which at the same time is cheap to produce and assemble, compact, highly reliable, and of attractive appearance, and enables the user to open the door by simply pressing a button.

According to the present invention, there is provided a device for opening a door of an electric household appliance, as claimed in the attached claims.

More specifically, the opening device according to the invention is designed for an electric household appliance door mounted to swing, about a normally substantially vertical axis of rotation, between an open position, and a closed position in which, with the interposition of a peripheral seal, it is retained against a door stop on a door opening of the appliance by retaining means releasable by simply detaching the door from the door stop on the door opening.

More preferably, the door of the appliance is pushed into the open position by elastic means on the appliance, and the opening device comprises a supporting member fixable integrally to the door; a button fitted integrally to the supporting member to stay, in use, on the same side of an outer surface of the door, and which is pressure-operated in opposition to first elastic means; a push member fitted to the supporting member to slide, in opposition to second elastic means and along an axis substantially perpendicular to the axis of rotation of the door, between an extracted position extracted from a seat on the supporting member, and a withdrawn position housed inside the seat, which is so formed as to be located, in use, at and substantially flush with the peripheral seal; and bolt means for selectively engaging the push member to lock it in the withdrawn position, and releasing the push member when said button is pressed.

The bolt means comprise a latch member fitted to the supporting member to slide, crosswise to the travel axis of the push member, between a first position, in which it interferes with the push member and engages a transverse through seat, formed through a lateral wall of the push member, to lock the push member in the withdrawn position in opposition to the second elastic means, and a second position, in which it does not interfere with the push member; third elastic means fitted integrally to the supporting member to push the latch member into the first position; and a substantially L-shaped pawl fitted to the supporting member to rotate about a fulcrum, and having a first end which projects radially with respect to the fulcrum and cooperates with the button, and a second end which also projects radially with respect to the fulcrum and engages the latch member.

In the extracted position, the push member projects with respect to the peripheral seal towards the door stop on the door opening, so as to cooperate with the door stop to move the door into a detached position detached from the door stop by a predetermined amount (G) sufficient to release the releasable door retaining means.

According to one aspect of the invention, a first end of the push member, facing away from the button, has an adjusting device for adjusting the detached position of the door, and which comprises a first inclined surface formed integrally with the first end of the push member; a square-like slide having a second inclined surface cooperating with and sliding on the first, and a third inclined surface facing away from the second; and a screw connecting the first end of the push member to the slide through a slot formed through the slide, and the head of which acts in contact with the third inclined surface; the first, second and third inclined surface being crosswise to the travel axis of the push member.

Consequently, as it is extracted from the seat, the push member, by virtue of the second elastic means, exerts sufficient backthrust on the door stop of the door opening to overcome the retaining force of the releasable retaining means and so open the door. The opening movement of the door is completed by the elastic means on the appliance acting on the door. The appliance door can therefore be opened by the user simply pressing the button, e.g. using an elbow if both hands are full, so that conventional handles may be eliminated.

The adjusting device, for adjusting detachment of the door when the push member is moved into the extracted position, enables the device according to the invention to be used with peripheral seals of different sizes. That is, the same opening device can be used on any appliance model, thus enabling enormous mass production saving, as well as compensating for any positioning errors caused by manufacturing tolerances, to ensure fast, reliable operation of the opening device according to the invention in all conditions.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
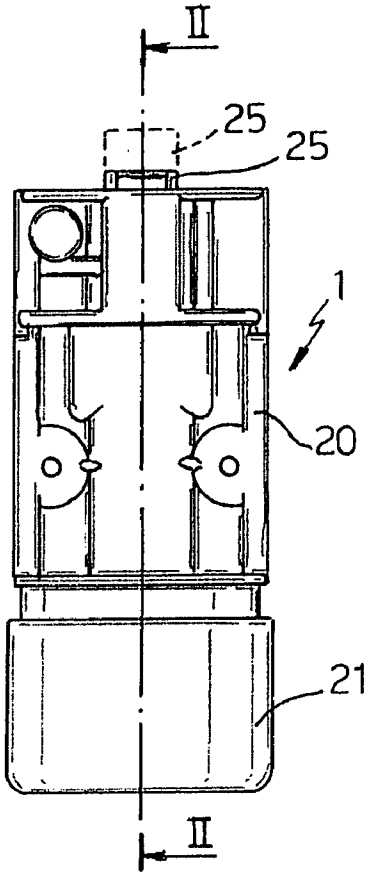
FIG. 1 shows a schematic longitudinal lateral elevation of an opening device in accordance with the invention.

With reference to FIGS. 1 to 4, number 1 indicates as a whole a device for opening a door 2 of an electric household appliance—in the example shown, a refrigerator.

Door 2 swings, about an axis of rotation A (FIG. 4) along the side of door 2 and preferably substantially vertical, between an open position (FIG. 3), and a closed position (shown schematically in FIG. 2) in which door 2 rests against a door stop 7 of a door opening 9 (FIG. 3), with the interposition of a peripheral seal 6 (normally integral with door 2). Door 2 is retained in the closed position by releasable retaining means 11 only shown schematically in FIG. 4.

Releasable retaining means 11 are of the type releasable by simply detaching door 2 from door stop 7, and include, for example, a member selected from the group comprising: suction cups, magnetic fasteners, click-on push-rods.

Appliance 3 also comprises elastic means 13 (shown schematically in FIG. 4), e.g. fitted coaxially with axis of rotation A between the casing of appliance 3 and door 2, to push door 2 into a fully-open position (not shown for the sake of simplicity) in which door 2 opens the whole of door opening 9. In the closed position, door 2 is therefore retained by releasable retaining means 11 in opposition to elastic means 13.

Device 1 comprises a supporting member 20 fixable integrally to door 2, e.g. to a vertical lateral edge of the door opposite axis A; a button 21 fitted integrally to supporting member 20 so as to stay, in use, on the same side of an outer surface of door 2, and which is pressed in opposition to first elastic means 22; and a push member 25 fitted to supporting member 20, on the opposite side to button 21, and which slides, in opposition to second elastic means 26 and along an axis B (FIG. 3) substantially perpendicular to axis of rotation A of door 2, between an extracted position (shown in FIG. 3 and by the dash line in FIG. 1) in which it is extracted from supporting member 20, and a withdrawn position in which it is housed inside a seat 27 on supporting member 20.

Seat 27 is so formed as to be located, in use, at and substantially flush with peripheral seal 6 of door 2.

According to a first aspect of the invention, device 1 also comprises bolt means 30 for selectively engaging push member 25 to lock it in the withdrawn position, and disengaging the push member when button 21 is pressed.

Figure 2:
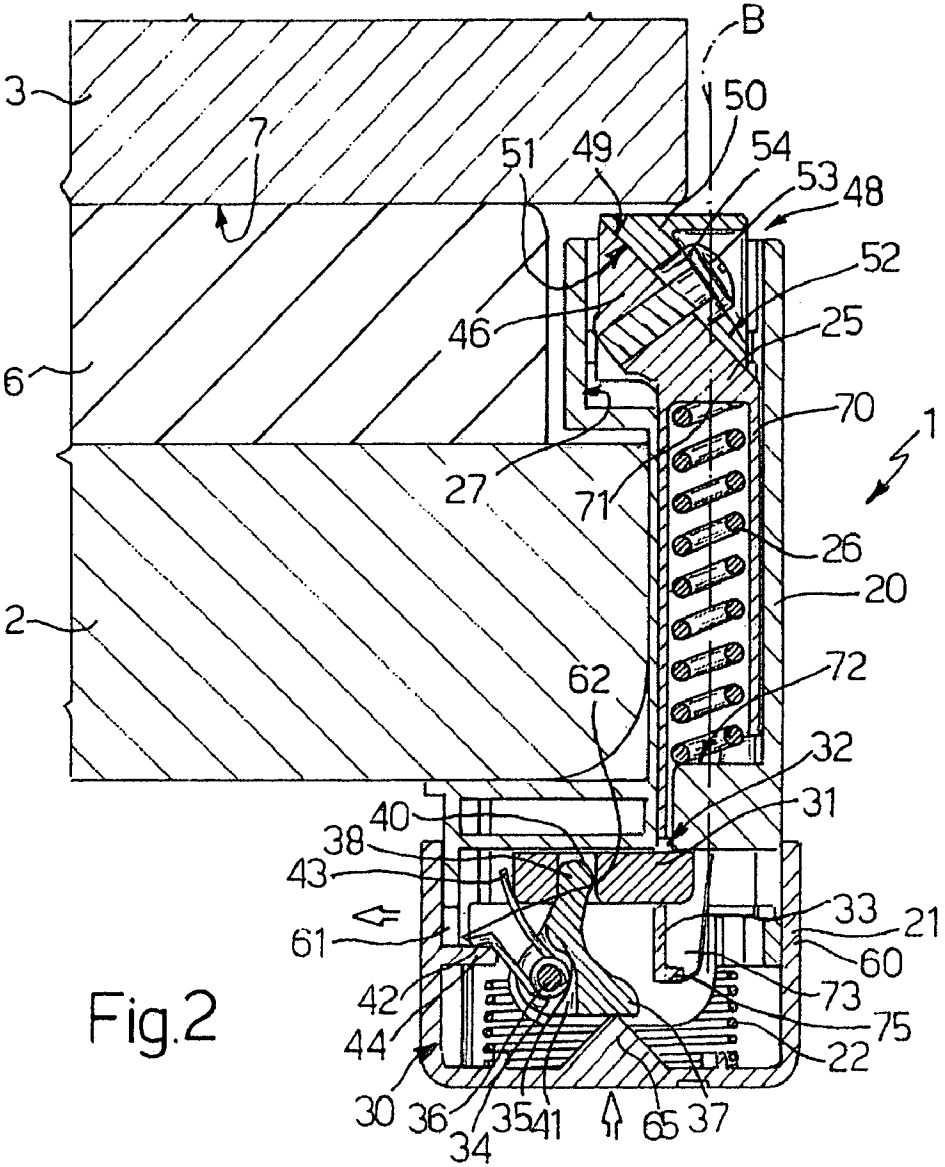
FIG. 2 shows a section along line II—II of the FIG. 1 device fitted to an electric household appliance door only shown schematically.
Figure 4:
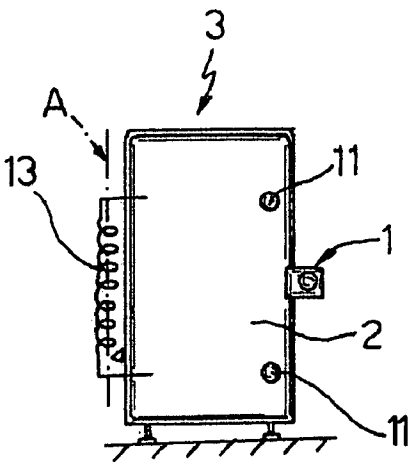
FIG. 4 shows a schematic overall front elevation of an electric household appliance fitted with the device according to the invention.
Figure 3:
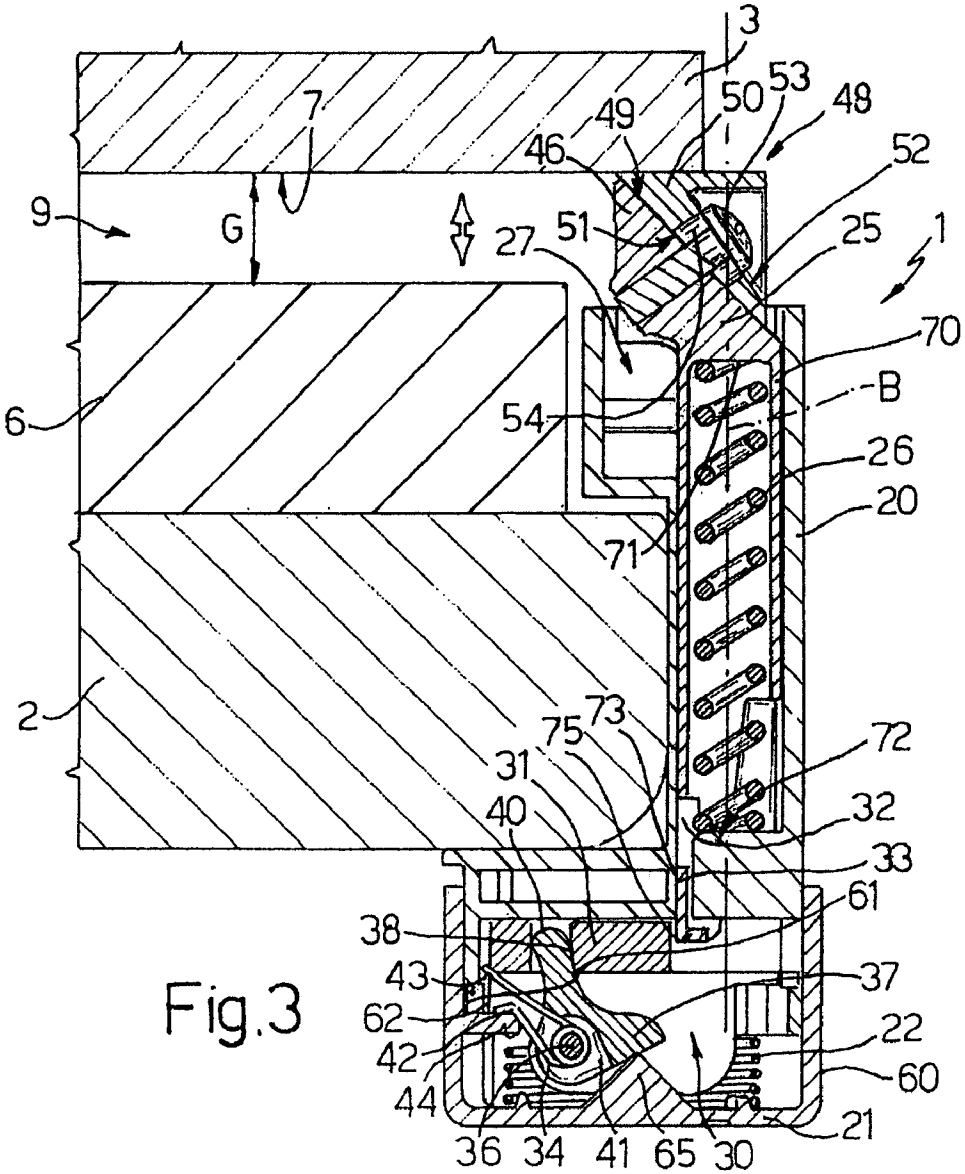
FIG. 3 shows the same view as in FIG. 2, of the device according to the invention in a different operating configuration.

Bolt means 30 comprise a latch member 31 fitted to supporting member 20 to slide, crosswise to axis B, between a first position (FIG. 2) and a second position (FIG. 3). In the first position, latch member 31 interferes with push member 25 and engages a transverse through seat 32, formed through a lateral wall 33 of push member 25, to lock the push member in the withdrawn position in opposition to elastic means 26; and, in the second position, latch member 31 does not interfere with push member 25.

Bolt means 30 also comprise third elastic means 34 fitted integrally to supporting member 20 to push latch member 31 into the first position; and a substantially L-shaped pawl 35 fitted to supporting member 20 to rotate about a fulcrum 36 eccentric with respect to the slide direction of latch member 31.

Button 21 cooperates with a first end 37 of pawl 35 projecting radially with respect to fulcrum 36; and a second end 38 of pawl 35, also projecting radially with respect to fulcrum 36, engages latch member 31—in the example shown, engages a transverse through hole 40 in latch member 31—and is lobe-shaped, as shown clearly in FIGS. 2 and 3, so as to be able to vary its angular orientation with respect to latch member 31, while still cooperating with hole 40, in which it is housed with a minimum amount of clearance.

According to a preferred aspect of the invention, third elastic means 34 comprise a V-shaped leaf spring fitted to fulcrum 36, partly housed in a radially through recess 41 of pawl 35, and having opposite arms 42, 43, which act respectively on a contrast member 44 of supporting member 20, and on a rear end of latch member 31 facing away from push member 25.

As shown clearly in FIG. 3, in the extracted position, push member 25 projects with respect to peripheral seal 6 towards door stop 7 on door opening 9, so as to cooperate with door stop 7 to move door 2 into a partially opened position detached from door stop 7 by a predetermined amount G sufficient to release releasable retaining means 11 of door 2.

To accurately adjust detachment G of door 2 of different models of appliance 3, or simply to compensate for manufacturing tolerances, a first end 46 of push member 25, facing away from button 21, has an adjusting device 48 for adjusting the detached position of door 2.

Adjusting device 48 comprises a first inclined surface 49 formed integrally with end 46; and a square-like slide 50 having a second inclined surface 51 cooperating with and sliding on surface 49, and a third inclined surface 52 facing away from surface 51.

Adjusting device 48 also comprises a screw 53 (or other equivalent connecting and actuating means) connecting end 46 of the push member to slide 50 (which is thus connected integrally to push member 25) through a slot 54 formed through slide 50; and the head of screw 53 acts in contact with surface 52, which, like surfaces 49 and 51, is crosswise to the travel axis B of push member 25.

Screwing/unscrewing the screw on end 46 therefore stresses surface 52 to move slide 50, along surfaces 49 and 51, with respect to end 46, and so back or forward, parallel to axis B, to reduce or increase as required—and with micrometric precision, depending on the pitch of screw 53—the total stick-out of push member 25 from seat 27 in the extracted position.

In the example shown, button 21 is defined by a cup-shaped body 60 clicked onto supporting member 20 (e.g. by means of flexible teeth 61 engaging slots 62) to slide parallel to axis B, and so that bolt means 30 are housed inside the concavity of cup-shaped body 60. A bottom wall of cup-shaped body 60 has a rounded projection 65 projecting in the travel direction of button 21, and which cooperates with and contacts end 37 of pawl 35, which is shaped accordingly.

In the example shown, push member 25 is defined by a dead tubular member 70 housing second elastic means 26, which comprise a helical spring, of appropriate length and rigidity, packed retained (e.g. gripped) between an end wall 71 of tubular member 70 and a shoulder 72 of supporting member 20. The end 73 of the dead tubular member opposite end wall 71 is uneven shaped (like the mouthpiece of a flute), so as to be flexible, and projects beyond shoulder 72, with which it cooperates, on the side facing button 21, by means of a projection 75, so as to define a stop for push member 25 in the extracted position, and so prevent expulsion of the push member by spring 26, which is preferably assembled preloaded. At the assembly stage, however, end 73 is flexible enough to insert push member 25 inside seat 27 by pushing it towards button 21 until projection 75 clicks past shoulder 72, which therefore works two ways (for spring 26 in one direction, and for projection 75 in the other).

Elastic means 22 are also defined by a helical spring, which is gripped, about projection 65, between the bottom wall of cup-shaped body 60 and contrast member 44, which therefore also functions as a two-way shoulder: for leaf spring 34 on one side, and for helical spring 22 on the other.

Elastic means 26 must therefore be sized and assembled to push push member 25—when not engaged by latch member 31—into the extracted position with greater force than that exerted on the closed door 2 by releasable retaining means 11 of appliance 3.

Device 1 as described operates as follows.

When door 2 is closed (FIG. 2), the push member is locked in the withdrawn position by latch member 31 engaging seat 32 in opposition to spring 26, which is compressed.

In this condition, if even only slight pressure is applied by the user on button 21 in the direction of the arrow, projection 65 pushes on and so rotates end 37 of pawl 35 anticlockwise about fulcrum 36 in opposition to spring 34, so that latch member 31 withdraws from seat 32 to release push member 25, which is clicked rapidly by spring 26 into the extracted position (FIG. 3) to detach door 2 by a sufficient amount G to disable retaining means 11.

At this point, door 2 can be fully opened "automatically" by spring 13. As and also after door 2 is opened, even if button 21 is released by the user, thus relaxing spring 22, latch member 31 remains locked in the withdrawn position, with pawl 35 rotated into the FIG. 3 position, by virtue of push member 25, as it moves into the extracted position, moving seat 32 past shoulder 72, so that latch member 31 is locked resting against lateral wall 33 of tubular member 70, against which it is pushed by spring 34.

To close door 2, the user simply pushes it back onto door stop 7 of door opening 9, in opposition to spring 13. When so doing, push member 25, which is still in the extracted position, contacts door stop 7 first, by which it is pushed back into the withdrawn position, thus loading spring 26 and restoring seat 32 to its former position facing latch member 31. Spring 34 therefore pushes latch member 31 inside seat 32 to lock the push member in the withdrawn position and rotate pawl 35 clockwise back into the start position with end 37 resting on projection 65.

As compared with other devices for detaching door 2 using a spring-loaded push member, similar to member 25, and which are the object of parallel patent applications by the present Applicant, device 1 as described has the major advantage of the force required to operate button 21 being independent of the rigidity of spring 26, so that, to operate button 21, the user only has to overcome the resistance of springs 22 and 34.

The invention claimed is:

1. A device for opening a door of an electric household appliance; the door swinging, about an axis of rotation, between an open position, into which it is pushed by elastic elements, and a closed position, in which it is retained, with the interposition of a peripheral seal, resting against a door stop of a door opening of the appliance by releasable retaining elements; the device comprising a supporting member fixable integrally to the door, and a button fitted integrally to the supporting member to stay, in use, on the same side of an outer surface of the door, and which is pressure-operated in opposition to first elastic elements; the device comprising a push member fitted to the supporting member to slide, in opposition to second elastic elements and along a travel axis substantially perpendicular to the axis of rotation of the door, between an extracted position extracted from a seat on the supporting member, and a withdrawn position housed inside the seat, which is so formed as to be located, in use, at and substantially flush with the peripheral seal; and bolt elements for selectively engaging the push member to lock it in the withdrawn position, and releasing the push member when said button is pressed.

2. A device as claimed in claim 1, wherein, in said extracted position, said push member projects, in use, with respect to said peripheral seal and towards said door stop of the door opening, so as to cooperate with said door stop to move said door into a detached position detached from said door stop by a sufficient predetermined amount to release said releasable retaining elements of the door.

3. A device as claimed in claim 2, wherein a first end of the push member, facing away from the button, has an adjusting device for adjusting the detached position of the door; said adjusting device comprising a first inclined surface formed integrally with said first end of the push member; a square-like slide having a second inclined surface cooperating with and sliding on the first, and a third inclined surface facing away from the second; and a screw connecting the first end of the push member to the slide, through a through slot in the slide, and a head of which acts in contact with said third inclined surface; said first, second and third inclined surface being crosswise to said travel axis of the push member.

4. A device as claimed in claim 2, wherein said second elastic elements push said push member into said extracted position with a greater force than that exerted by said releasable retaining elements on said door to hold the door in the closed position.

5. A device as claimed in claim 1, wherein said bolt elements comprise a latch member fitted to said supporting member to slide, in a direction crosswise to said travel axis of said push member, between a first position, in which it interferes with said push member and engages a transverse through seat formed through a lateral wall of the push member, so as to lock the push member in the withdrawn position in opposition to the second elastic elements, and a second position, in which it does not interfere with said push member.

6. A device as claimed in claim 5, wherein said bolt elements also comprise third elastic elements fitted integrally to the supporting member to push said latch member into said first position; and a substantially L-shaped pawl fitted to the supporting member to rotate about a fulcrum eccentric with respect to the slide direction of the latch member; said button cooperating with a first end of the pawl projecting radially with respect to the fulcrum; and a second end of the pawl, also projecting radially with respect to the fulcrum, engaging said latch member.

7. A device as claimed in claim 6, wherein said button is defined by a cup-shaped body clicked onto the supporting member to slide in a direction parallel to said travel axis of the push member; said bolt elements being housed in the concavity of said cup-shaped body, a bottom wall of which has a rounded projection projecting in the slide direction of the button and cooperating in contact with said first end of the pawl.

8. A device as claimed in claim 7, wherein said second end of the pawl engages a transverse through hole in the latch member, and is so shaped as to vary its angular orientation with respect to the latch members, while still cooperating with said hole.

9. A device as claimed in claim 7, wherein said third elastic elements comprise a leaf spring fitted to said fulcrum, partly housed in a through recess of said pawl, and having opposite arms which act respectively on a contrast member of said supporting member, and on a rear end of the latch member facing away from the push member.

10. A device as claimed in claim 1, wherein said push member is defined by a dead tubular member housing said second elastic elements, which are gripped between an end wall of the tubular member and a shoulder of said supporting member; one end of the dead tubular member, opposite said end wall, being unevenly shaped like the mouthpiece of a flute, and projecting beyond said shoulder of the supporting member towards said button.

11. An electric household appliance, in particular a refrigerator or freezer, comprising a door which is pushed into an open position by elastic elements, and is retained in a closed position, in opposition to the elastic elements, by releasable retaining elements; the electric household appliance also comprising an opening device as claimed in claim 1.

12. An electric household appliance as claimed in claim 11, wherein said releasable retaining elements comprise a member selected from the group comprising: suction cups, magnetic fasteners, and click-on push rods.

* * * * *